United States Patent [19]

Pali

[11] Patent Number: 4,555,070

[45] Date of Patent: Nov. 26, 1985

[54] METHOD AND APPARATUS FOR UNWINDING AND SPLICING SUCCESSIVE ROLLS

[75] Inventor: Christopher Pali, Fort Wayne, Ind.

[73] Assignee: Essex Group, Inc., Fort Wayne, Ind.

[21] Appl. No.: 617,292

[22] Filed: Jun. 4, 1984

[51] Int. Cl.[4] ..... B65H 19/12; B65H 19/18

[52] U.S. Cl. ..... 242/58.1; 156/157; 156/502

[58] Field of Search ..... 242/58, 58.1, 58.2, 242/58.3, 58.4, 58.5, 58.6; 156/157, 502, 504, 507, 509

[56] References Cited

U.S. PATENT DOCUMENTS

| | | | |
|---|---|---|---|
| 2,386,345 | 10/1945 | Roesen | 242/58 |
| 3,460,775 | 3/1967 | Ford et al. | 242/58.3 |
| 3,547,739 | 12/1970 | Beute | 156/504 |
| 3,592,010 | 6/1971 | Whiteman | 242/58 |
| 3,645,463 | 2/1972 | Helm | 242/58.1 |
| 3,771,737 | 11/1973 | Swann | 242/58.1 |
| 3,775,223 | 11/1973 | Moseley et al. | 242/58.1 X |
| 3,813,053 | 5/1974 | Butler, Jr. | 242/58.4 |
| 3,995,791 | 12/1976 | Schoppee | 242/58.1 |
| 4,077,580 | 3/1978 | Lang | 242/58.2 |
| 4,081,312 | 3/1978 | Christiani | 156/504 |
| 4,108,391 | 8/1978 | Martinez | 242/58.3 |
| 4,238,261 | 12/1980 | Tetro | 156/157 |

FOREIGN PATENT DOCUMENTS

| | | | |
|---|---|---|---|
| 59110 | 9/1982 | European Pat. Off. | 242/58.6 |
| 2056416 | 3/1981 | United Kingdom | 242/58.1 |
| 2098182 | 11/1982 | United Kingdom | 242/58.3 |

*Primary Examiner*—Stuart S. Levy
*Assistant Examiner*—Lloyd D. Doigan
*Attorney, Agent, or Firm*—Robert P. Hayter

[57] ABSTRACT

A method and apparatus for unwinding and splicing successive rolls of ribbon material is disclosed. A roll payoff unit including a paster arm having clamping means, cutting means and means for holding the trail end of a cut ribbon in position is provided. Additionally an adhesive means for supplying adhesive to an appropriate portion of the trail end of the ribbon is disclosed. The ribbon is then mated with the beginning end of a new roll to secure the trail end of the old roll to the new roll to provide a continuous ribbon.

15 Claims, 12 Drawing Figures

METHOD AND APPARATUS FOR UNWINDING AND SPLICING SUCCESSIVE ROLLS

BACKGROUND OF THE INVENTION

This invention relates to a method and apparatus for unwinding and splicing successive rolls of ribbon type material. More particularly the present invention concerns a payoff assembly capable of unwinding one roll of material, cutting the end of the roll, receiving a successive new roll of material and thereafter joining the trail end of the old roll to the beginning end of the new roll. A drive mechanism for rotating the roll and a dancer for regulating the speed of the drive mechanism are additionally included.

The payoff assembly as used herein is designed to unwind a roll of material, allow the empty core from the roll to drop to the ground, replace the empty core with a new roll of material in the proper orientation and to paste the trail end of the old roll to a paster tab and the beginning end of a new roll such that a continuous ribbon may be supplied to an end use. A robot assembly is used to replace the roll such that rolls may be continually replaced up to a frequency of one every six minutes to allow a continuous ribbon of material to be supplied.

SUMMARY OF THE INVENTION

It is an object of the present invention to provide a system for unwinding a roll of ribbon material.

It is a further object of the present invention to provide apparatus and a method for controlling the speed and manner in which a roll of material is unwound.

It is a yet further object of the present invention to provide a method and apparatus for splicing the trail end of an old roll of ribbon material to the beginning end of a new roll of ribbon material.

It is a still further object of the present invention to provide a paster arm assembly pivoting about a pulley through which the ribbon passes and including both clamping means for clamping the ribbon to maintain tension therein and cutting means for severing the old ribbon from the old roll.

It is a further object of the present invention to provide apparatus and a method for splicing the trail end of an old roll of ribbon to the beginning end of a new roll of ribbon.

It is another object of the present invention to provide safe, economical, reliable, easy to maintain and service equipment for unwinding a roll of material and splicing successive rolls together.

Other objects will be apparent from the description to follow and the appended claims.

The preceding objects are achieved according to the preferred embodiment of the invention by the provision of a roll payoff unit for unwinding rolls of ribbon material having a central annular core and an outside diameter. The roll payoff unit includes a retractable core chuck upon which the roll of material is mounted, said chuck having a first position wherein the roll is secured through the core and a second position wherein the chuck is retracted releasing the roll; a drive belt assembly including an endless drive belt engaging the exterior surface of the roll, said assembly being pivotally mounted to continuously engage the outside diameter of the roll as the roll diameter decreases during unwinding of the roll; pulley means for guiding the ribbon being unwound from the roll; dancer means to sense and control ribbon tension by regulating the speed of the endless drive belt; and a paster arm assembly for use in joining the trail end of the ribbon from a consumed roll to the beginning end of the ribbon from a new roll including means for clamping the ribbon and means for cutting the ribbon, said assembly being mounted to pivot between several positions including a cutting position in registration with the ribbon when the roll is almost completely consumed and an unwinding position not in registration with the ribbon.

Additionally apparatus for splicing the trail end of a roll of ribbed material onto the beginning end of a new roll of material is disclosed. This apparatus includes a core chuck for securing both the old and new rolls for rotational movement to allow unwinding, said rolls being mounted on the chuck in a preselected orientation; a pivotally mounted paster arm assembly including (a) clamp means for releasably securing the ribbon to maintain tension on the ribbon; (b) knife means for severing the ribbon; and (c) vacuum means for holding the severed ribbon in a desired position; actuator means for displacing the paster arm assembly; and adhesive means for applying adhesive to the ribbon where secured by the vacuum means.

DESCRIPTION OF THE PREFERRED EMBODIMENT

Figure 1:
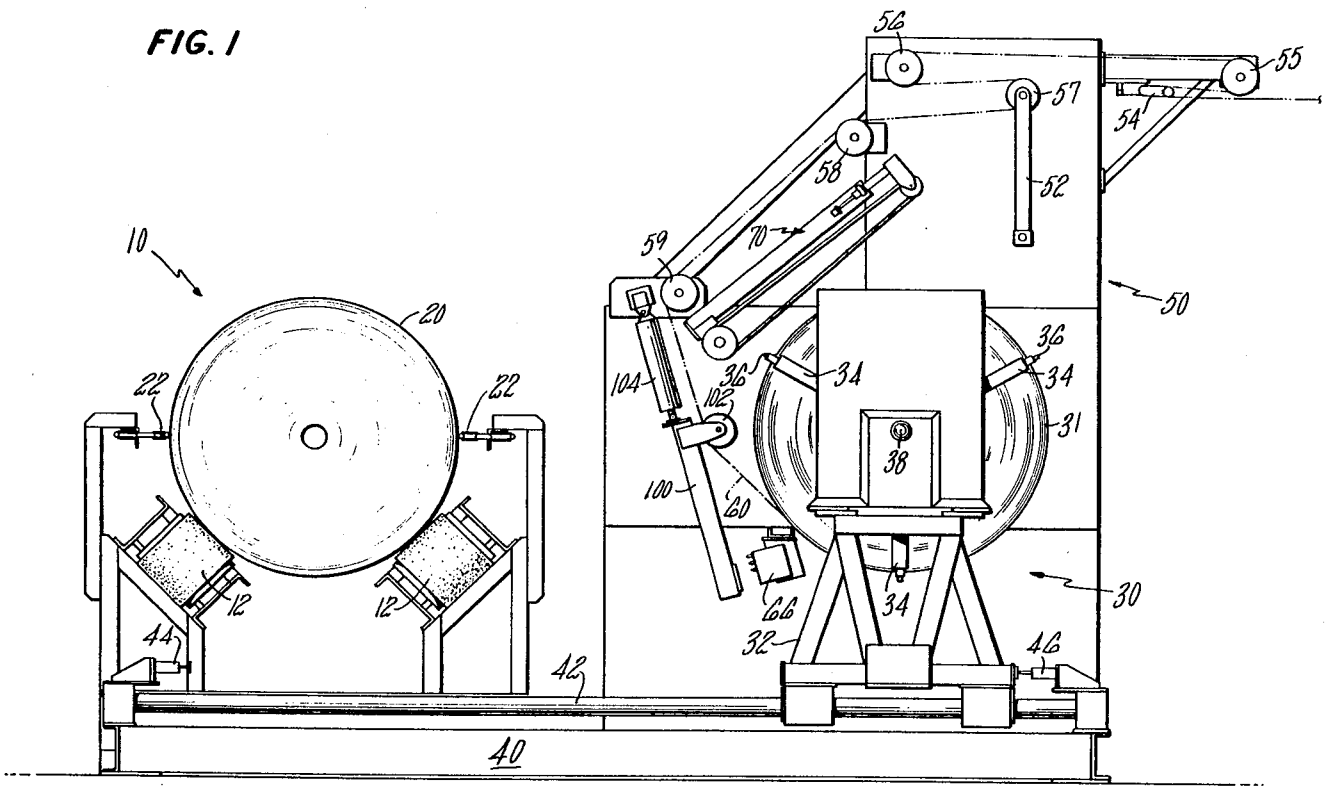
FIG. 1 is a front plan view of a conveyor assembly, robot assembly and payoff assembly.
Figure 2:
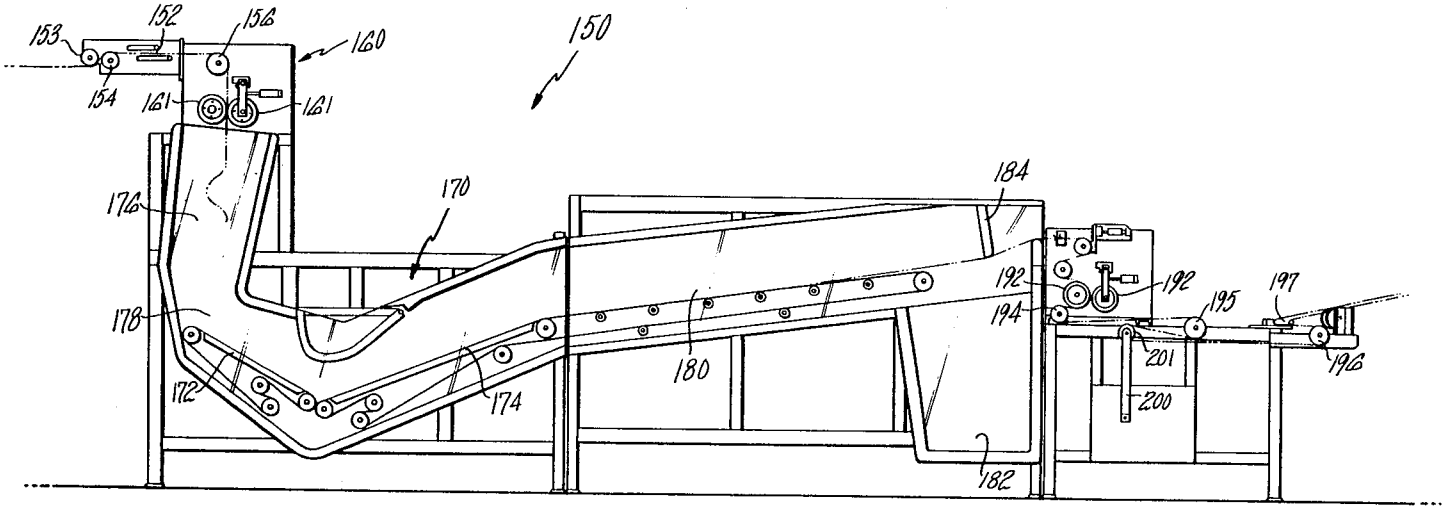
FIG. 2 is a front plan view of a ribbon feeder and accumulator assembly and a feed-up assembly.
Figure 3:
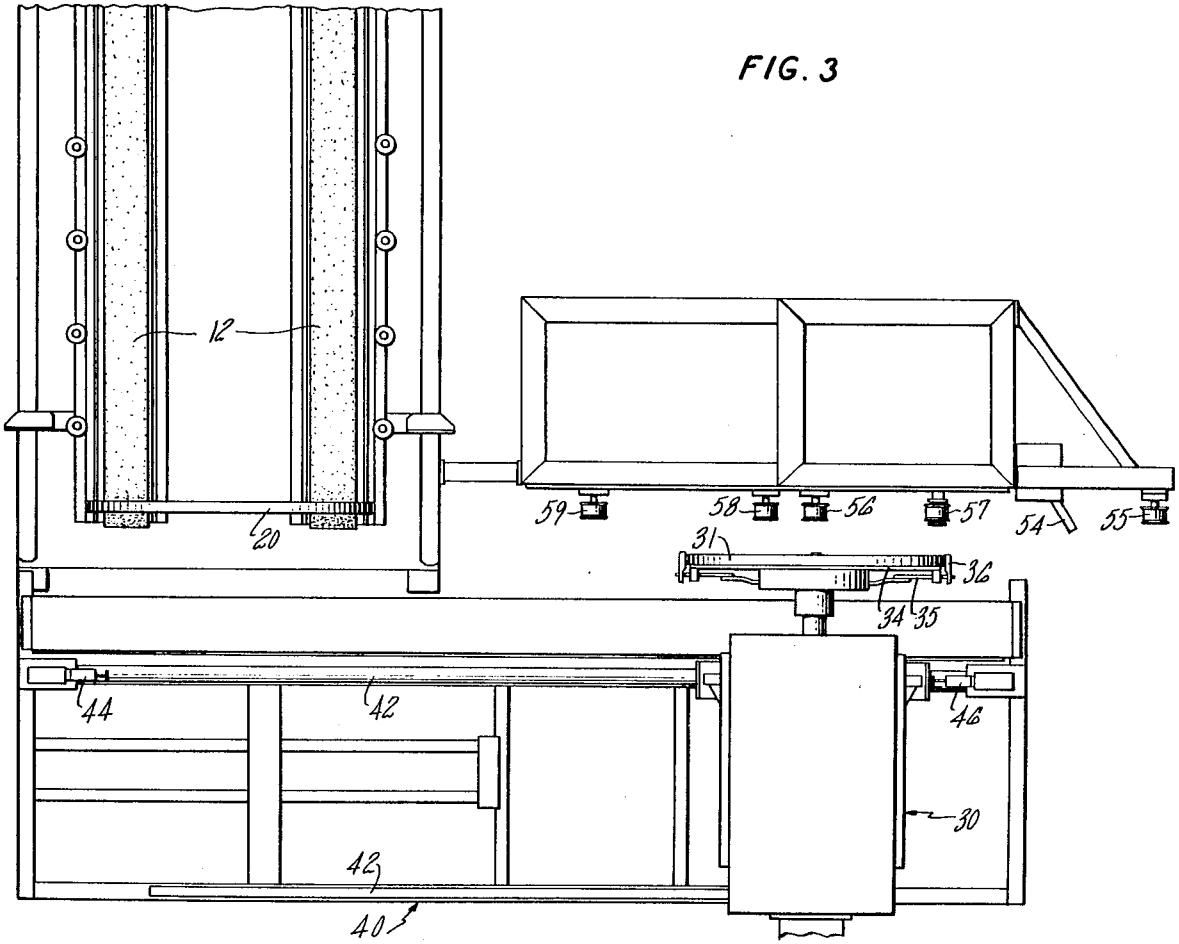
FIG. 3 is a top plan view of the conveyor assembly, robot assembly and payoff assembly.

Referring to FIGS. 1–3 there may be seen a front plan view and a partial top view of a complete ribbon feed system for supplying paper ribbon from large rolls of ribbon to an end use at a high rate of speed. It is anticipated that ribbon as required for a particular use may come in rolls up to three feet in diameter and may be of varying widths. The specific use for which the herein equipment was designed is to supply paper to a wire production facility. This paper is typically of a width between one and one and a half inches. It is desirable to supply the paper at speeds in the 2,000–5,000 feet per minute range. This paper supply system could, of course, be used for other applications, with other ribbon material and with rolls of stock of varying sizes.

Each paper roll of the dimensions mentioned contains approximately 17,000 lineal feet of paper. At the desired unwinding speeds an individual paper roll is completely consumed in 4–9 minutes. The equipment herein is designed to allow another roll to be mounted automatically and joined to the previous roll such that the wire production facility may operate continuously including without interruption when paper rolls are being changed. Absent such machinery it would be necessary to provide attendants for this machinery for the purpose of loading paper rolls.

FIG. 1 is a front plan view of a conveyor assembly, a paper payoff assembly and a robot assembly. Conveyor assembly 10 consists of two parallel mounted conveyor belts 12 having a series of paper rolls 20 stacked vertically therebetween. The length of the conveyor belts depends upon the number of paper rolls desired to be mounted on the conveyors at one time. The length is theoretically unlimited. The conveyor assembly includes means to advance the conveyor belts to move paper rolls 20 forward at a position where robot assembly 30 may grasp and remove the roll from the conveyor belts. Position sensors 22 are shown located one on either side of the paper roll to indicate that the paper roll has been advanced to a pickup position. The conveyor belts are typically operated to advance the paper rolls until the position sensors are tripped by contact with the paper roll.

Robot assembly 30 is mounted on rails 42 for left-to-right motion as seen in FIG. 1. Position stops 44 and 46 are utilized to control the position of robot assembly 30. Robot assembly 30 includes arms 34 containing clamp jaw mechanisms for securing paper roll 31. A central shaft for allowing rotation of the entire paper roll is further provided. The robot assembly may traverse to the left, mechanically grasp and remove a paper roll from the conveyor assembly, and thereafter traverse to the right until aligned with the paper payoff assembly. The robot assembly then acts to position the paper roll on paper payoff assembly 50. Once the paper roll is on paper payoff assembly 50 paper ribbon 60 is directed over pulleys 102, 59, 58, 57, 56, and 55 serially. The ribbon then passes over angle bar 54 and continues to the ribbon feeder and accumulator assembly 150 of FIG. 2. Paper payoff assembly 50 further includes a paster arm assembly 100, glue applicator 66, drive belt assembly 70, and dancer arm 52. The paster arm assembly includes apparatus for holding and cutting the ribbon after a paper roll has been unwound. Glue applicator 66 is utilized to provide adhesive to the trail end of the consumed paper roll such that the trail end of the ribbon from the consumed paper roll may be connected to the beginning portion of the ribbon of the new roll mounted on the paper payoff assembly by the robot assembly.

Drive belt assembly 70 consists of a drive belt operated to rotate the paper roll at a desired speed to supply ribbon to the end use. The ribbon passes over pulley 57 which is mounted on dancer arm 52. The position of dancer arm 52 is used to control the speed of drive belt 70 for regulating the payoff rate of ribbon 60.

FIG. 3 is a top plan view of FIG. 1 showing the relative positioning between the various elements. It may be seen that conveyor assembly 20 includes conveyor belts 12 extending whatever distance desired. Paper roll 20 is shown at the end of the conveyor assembly.

Robot assembly 30 is shown mounted for left-to-right movement on rails 42 of machine frame 40. Position stops 44 and 46 are shown for appropriately positioning the robot assembly.

Robot assembly 30 is additionally shown holding paper roll 31 with clamp jaws 36. Clamp jaws 36 are connected to drivers 35 for manipulating the jaws radially inwardly and outwardly. Arm 34 is shown for securing the driver and clamp jaw for sliding motion relative thereto. Pulleys 56 through 59 of the paper payoff assembly are additionally shown to indicate the relative positioning therebetween. Paper roll 31 shown clamped in the robot assembly is in position to be mounted on a core latch chuck of the paper payoff assembly. The robot assembly will advance the paper roll toward the top of FIG. 3 to place it in on the core latch chuck and in alignment with the pulleys indicated on the payoff assembly.

FIG. 2 is a front plan view of a ribbon feeder and accumulator assembly 150. The ribbon feeder and accumulator assembly is utilized to store sufficient ribbon that during the time interval between the consumption of one paper roll and the mounting of a new paper roll by the robot assembly that the process to which the paper is supplied may continue to operate with paper being continuously supplied from the ribbon feeder and accumulator assembly. To supply paper for this interval when no paper is being unwound, it is necessary to store a sufficient quantity of paper that operation of the end use may continue. Under the circumstances described it might be appropriate to store from 1,000–5,000 lineal feet of paper ribbon in the feeder and accumulator assembly.

The ribbon feeder and accumulator assembly includes stacking box 170 having feed chute 176, stacking area 178 and storage area 180. Ribbon is supplied through pulleys 153 and 154, through static eliminator 152 and around pulley 156 to feed wheels 160. Feed wheels 160 direct the ribbon into the stacking area and include urethane tire-like portions for effectively stiffening the ribbon such that it is directed in a straight path resulting in the ribbon being folded in large loops in the stacking area. Stacks of ribbon from the stacking area are conducted by ramp conveyor belt 172 downwardly and to the right. Storage conveyor belt 174 then directs the stacks of ribbon into storage area 180. The pack lean reversing shoe 175 is positioned to create a resistance at the top portion of the folds such that as the folds of paper are switched from ramp conveyor belt 172 to storage conveyor belt 174 the direction of lean of the folds is reversed. Reversing the direction of lean of the paper in the storage area allows the paper to be removed from the storage area without pulling the paper from the bottom of the pack thereby reducing the force required to physically pull the paper from the storage area. Spill box 182 is utilized to store excess folds when inadvertently dumped thereinto. Fold stripper 184 acts to remove the folds from the paper.

Feed-up assembly 190 includes supply wheels 192 for supplying paper to the end use at the desired rate, pulleys 194, 195, 196, 197 and dancer 200 having pulley 210. The position of dancer 200 is sensed and thereafter used to regulate the supply wheels to control the rate of feed of paper ribbon to the end use. The remaining pulleys simply act to guide the paper through the feed-up assembly.

Figure 4:
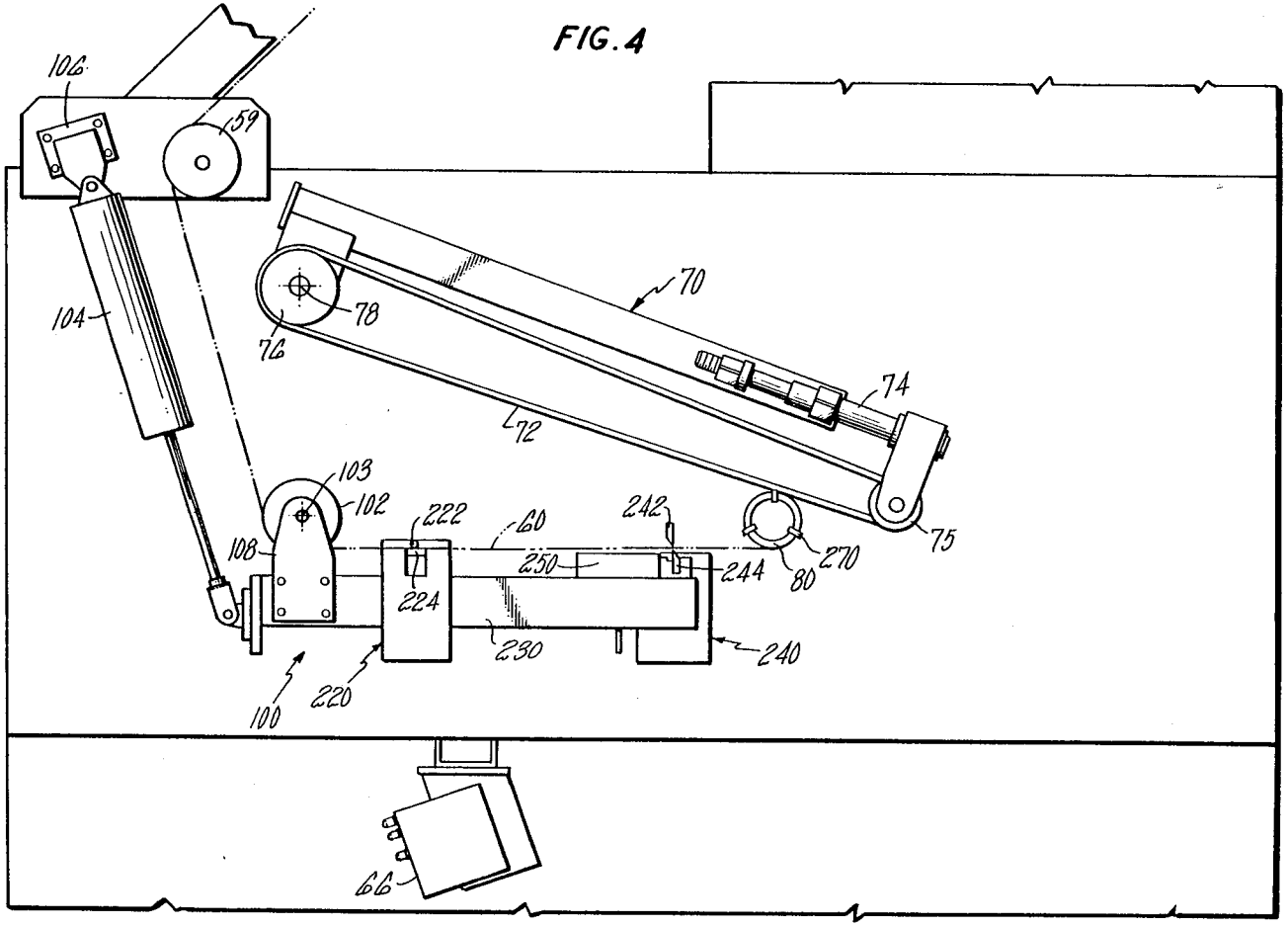
FIG. 4 is a partial front view of the payoff assembly with the paster arm in the cutting position.
Figure 5:
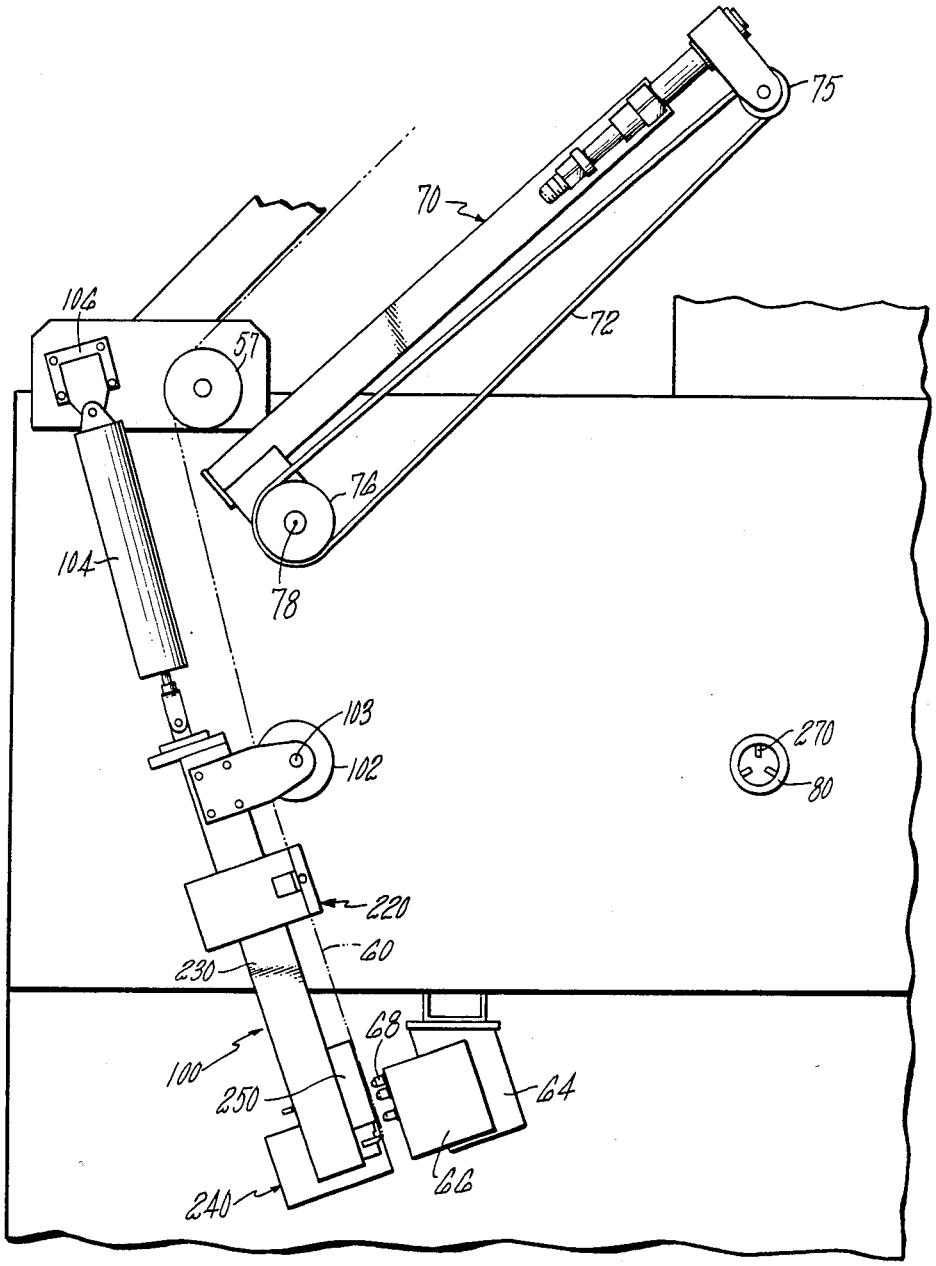
FIG. 5 is a partial plan view of the front payoff assembly with the paster arm in the adhesive position.
Figure 6:
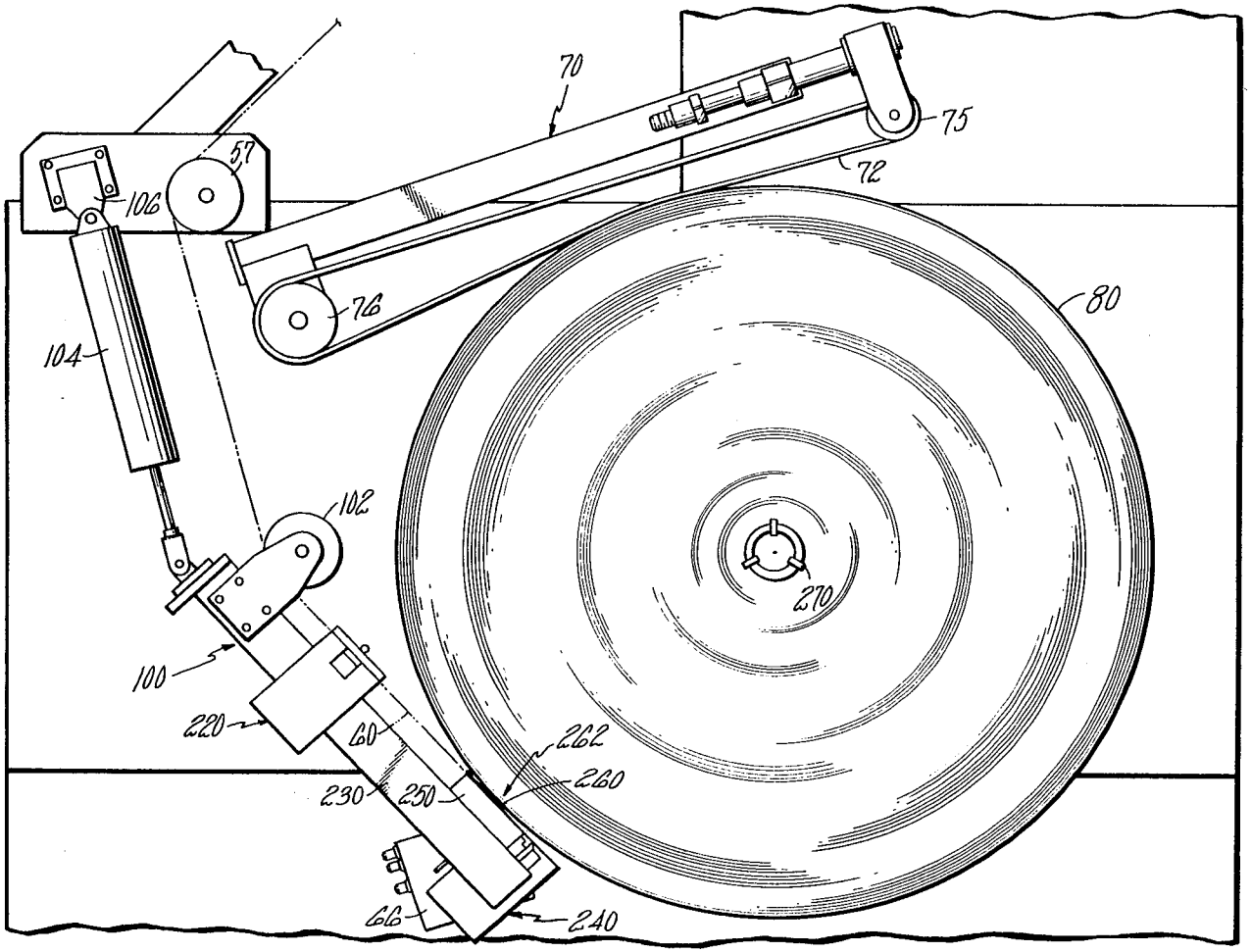
FIG. 6 is a partial front view of the payoff assembly with the paster arm in the fastening position.

FIGS. 4, 5 and 6 all disclose portions of the paper payoff assembly in different modes of operation. FIG. 1 is a plan view of the paper payoff assembly with the robot assembly located in front thereof showing a paper roll secured by the robot and (hidden from view) a separate paper roll being unwound. FIG. 4 shows a portion of the paper payoff assembly with the paper roll virtually depleted and the paster arm in position to sever the ribbon. The paper roll 80 is shown being secured through the center thereof by core latch gears 270. From paper roll 80 ribbon 60 extends to the left around pulley 102 and then upwardly around pulley 59. Drive belt assembly 70 having drive belt 72, support and tension arm 74 and pulleys 75 and 76 supported thereby provides a means for rotating the paper roll at the desired speed. A motor not shown drives pulley 76 at the desired speed based upon the position of dancer arm 52 to supply the ribbon of paper at the desired consumption rate. The entire drive belt assembly 70 pivots about pivot point 78 which is both the center point of pulley 76 and of the drive belt assembly such that the drive belt may rotate to be continually in contact with the paper roll.

Paster arm assembly 100 is shown in a raised position in FIG. 4. In this position it may be seen that ribbon clamp assembly 220 includes a clamp bar 222 positioned to secure ribbon 60 between the clamp bar and clamp pad 224. Additionally vacuum cup 250 may be seen extending from paster arm assembly 100. This vacuum cup is made slightly arcuate to be configured to mate with the exterior surface of a full paper roll and includes on the surface thereof a neoprene type covering having a myriad of small holes through which a vacuum is drawn to secure the ribbon relative thereto.

Positioned on the paster arm immediately downstream from the vacuum cup is ribbon knife assembly 240 including knife blades 242 and 244 which may be actuated to sever ribbon 60. Actuator 104 is shown connected between pivot support 106 and the main portion of the paster arm assembly. The paster arm assembly is connected via arm support 108 to pulley 102. Pivot point 103 is the pivot point for pulley 102 and also the pivot point of the main portion of the paster arm assembly. Hence, when the actuator is energized and extends, the paster arm rotates about pivot point 103 to swing upwardly to be in alignment with the ribbon such that the ribbon may be clamped, secured by the vacuum cup and cut by the knife. Glue applicator 66 is shown at the bottom of the drawing and is mounted to slide in and out when appropriate.

In the position as shown in FIG. 4 the paper roll has been used up and the drive belt assembly is deenergized to bring the paper roll to a stop. The paster arm actuator is energized to rotate the paster arm up and the ribbon clamp assembly and ribbon knife assembly are actuated as will be explained later such that the clamp assembly secures the ribbon in position maintaining the tension in the ribbon between the ribbon clamp assembly and the dancer arm, the vacuum cup acts to secure the end of the ribbon and the knife assembly cuts the ribbon between paper roll 80 and the portion of the ribbon secured by the vacuum cup.

Referring now to FIG. 5 it may be seen that paper roll 80 is released from the paper payoff assembly by withdrawing core latch gears 270 and the core latch chuck assembly through the core of the paper roll such that the paper roll drops to the floor.

Drive belt assembly 70 has been raised upwardly such that it is withdrawn from the area in which a new paper roll will be mounted. Paster arm actuator 104 has been energized to cause the paster arm to rotate downwardly. The ribbon remains clamped by ribbon clamp assembly 220 and the end thereof is held in position by vacuum cup 250. In this position glue applicator 66 secured by slidable support 64 is displaced outwardly to align with the end of the ribbon secured by the vacuum cup. Nozzles 68 connected to the glue applicator 66 act to guide the application of the adhesive to selected spots on the end of the ribbon as secured by the vacuum cup.

Referring now to FIG. 6 it may be seen that a new paper roll 80 has been placed in position by the robot assembly and that the core chuck assembly has been reinserted through the paper core and that chuck gears 270 extend outwardly securing the paper roll in position. It may additionally be seen that drive belt assembly 70 has been rotated downwardly to engage the top of the paper roll such that it is in position to start rotating the paper roll when desired.

Actuator 104 of the paster arm assembly 100 has been slightly extended such that the paster arm rotates upwardly until it contacts the exterior wrap of paper roll 80. Paster tab 260 is shown mounted on the exterior of the paper roll and includes an index line 262 which has been previously utilized by the robot assembly to place the paster tab in position to be secured to the trail end of the ribbon. The trail end of the ribbon remains secured by the vacuum cup and is contacted with the paster tab and the beginning end of the new roll such that the adhesive supplied by glue applicator 66 acts to secure the trail end of ribbon 60 to paster tab 260 and the beginning end of new paper roll 80. Clamp assembly 220 is deenergized such that the ribbon is no longer clamped and the vacuum cup is additionally deenergized. At this point the actuator of paster arm assembly acts to remove the paster arm assembly back to its original position as shown in FIG. 1. Operation of the paper payoff assembly may now be recommenced with the drive belt acting to rotate the paper roll at the desired speed and the dancer acting to control that speed. Tension of the ribbon between the dancer arm and the new paper roll has been maintained since the clamp assembly maintained tension until the tail end of the old ribbon was secured to the new paper roll. Upon energization of the drive belt assembly the paster tab separates with a portion of the paster tab and the new paper roll being secured to the tail end of the old paper roll such that a continous paper ribbon is supplied to the end use. During this changeover interval when no paper is being supplied the paper stored in the feeder and accumulator is utilized.

During normal unwinding operation the paster arm is in position as shown in FIG. 1 for guiding ribbon from the paper roll. Upon the paper roll being depleted the paster arm advances to the position shown in FIG. 4 for clamping the ribbon and severing the ribbon. Once the ribbon is severed, the paster arm moves to the position shown in FIG. 5 to enable the application of adhesive to the ribbon and to allow the robot assembly to provide a new paper roll to the paper payoff assembly. The paster arm then moves to the position shown in FIG. 6, to join the old ribbon to the new ribbon. Thereafter the paster arm retracts to the position shown in FIG. 1 until the replacement cycle is needed again.

The core chuck assembly of the paper payoff assembly is utlized to secure the paper roll in position. The paper rolls as suppied sometimes have loose interior wraps which may result in telescoping such that the paper extends outwardly from the core and eventually collapses. The core latch chuck assembly as used herein was designed such that it may be completely withdrawn from the paper roll to allow the paper roll to drop to the floor after the paper roll has been depleted and such that it may be freely inserted within the paper core without the core latch gear extending upwardly to engage the paper roll. The core chuck assembly further includes a core latch gear which extends outwardly engaging the paper core of the roll from the interior to secure same and includes a core latch gear extending outwardly on the side of the paper roll adjacent the robot assembly to prevent outward telescoping of interior wraps of the paper roll.

Figure 7:
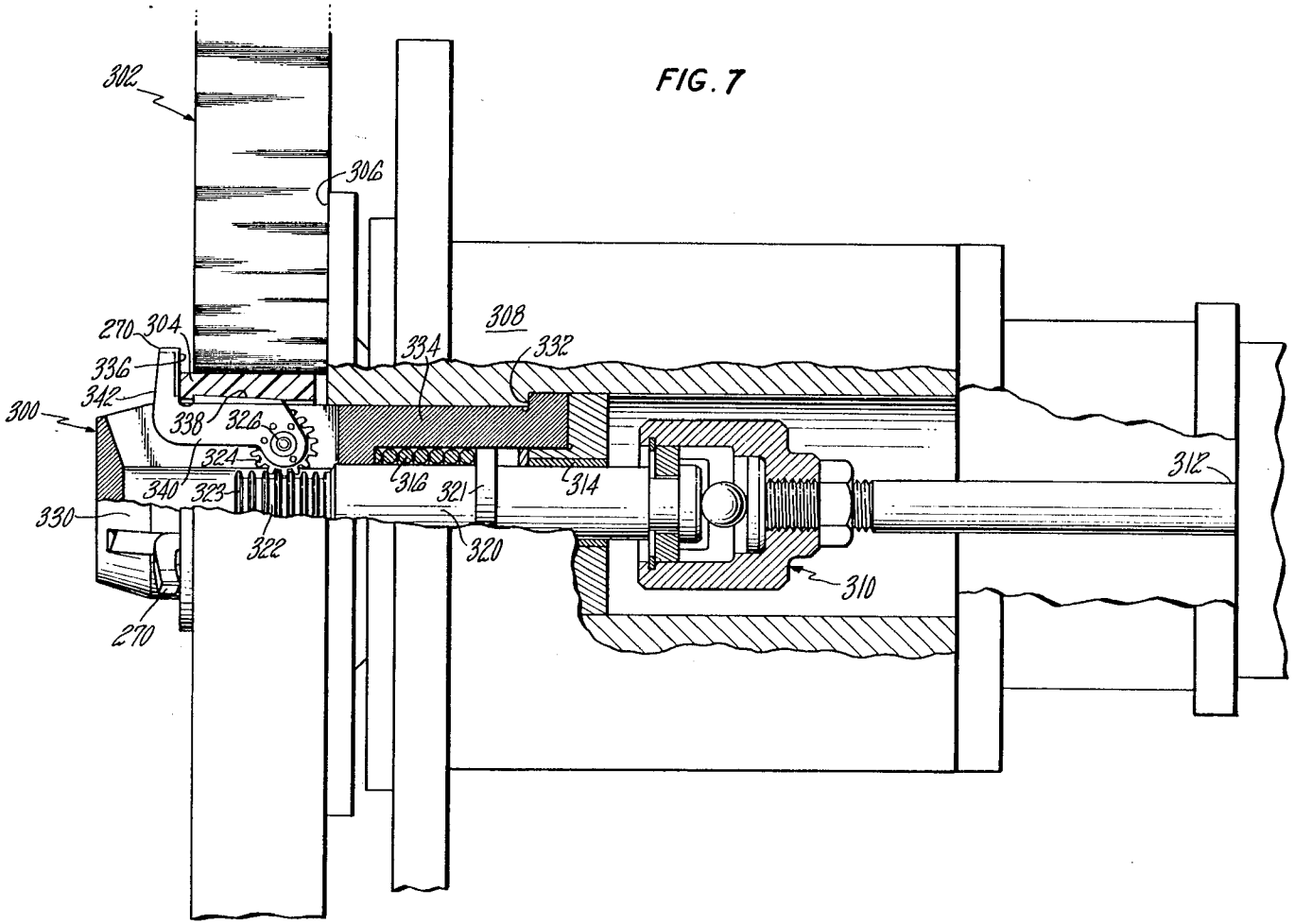
FIG. 7 is a partially cutaway view of a core chuck assembly securing a roll of ribbon in position.

Referring specifically to FIG. 7 it may be seen that paper roll 302 includes paper core 304. Core latch chuck assembly 300 is shown extending through the paper roll with core latch gear 270 extending outwardly having anti-telescoping face 336 mounted parallel to the paper roll to prevent the paper from being displaced away from frame 308. Core latch gear 270 additionally includes core engagement edge 338 which engages the interior surface of the paper core to secure the paper core relative thereto. Abutment face 306 is provided as part of the machine frame and serves to contain the paper roll from telescoping in the left-to-right direction. The anti-telescoping face 336 of the core latch gear serves a similar function preventing displacement of the paper in the right-to-left direction.

As can be seen in FIG. 7 core latch chuck assembly 300 includes an actuator 312 which may be an air powered cylinder for slidably displacing the entire assembly. It is to be understood that the core latch chuck assembly includes a portion which rotates with the paper roll and a portion which is secured to the machine. Rotary coupling 310 acts to separate actuator 312 which does not rotate from shaft 320 which does rotate. Rotary coupling 310 secures actuator 312 to shaft 320 to transmit sliding motion therebetween. Shaft 320 extends from the rotary coupling through bearing 314 and terminates in rack gear extension 322 which includes rack gear teeth 323 formed on the surface thereof. Spring 316 is mounted between shaft retainer 334 and shaft 320 and acts to bias the shaft toward the right as shown in the Figure by acting against shaft collar 321 projecting from the shaft. Additionally shaft retainer 334 includes abutment face 332 which may engage frame 308 to prevent further displacement of the core latch chuck assembly to the left. Core latch assembly casing 330 is shown at the bottom of the Figure.

Core latch gear 270 is shown mounted for rotational displacement on pin 326. Core latch gear 270 is connected to spur gear 324 which has teeth which engage rack gear teeth 323. Hence, upon relative movement between the rack gear and the spur gear the core latch gear is caused to rotate between the closed position as shown with the paper roll being held therebetween and the open position as shown in FIG. 8 with the gear being retracted within the core latch chuck assembly such that the assembly may be slid either into or out of the paper roll.

When it is desired to remove the core latch chuck assembly from the paper roll the actuator 312 moves to the right. Spring 316 places an expansion force between shaft retainer 334 and shaft collar 321. As actuator 312 moves to the right the shaft 320 moves to the right therewith. However, the spring acts to maintain shaft retainer 334 and core latch gear 270 in position until such time as the shaft collar 321 engages the edge of bearing 314 to cause the entire assembly to move to the right. During the time the shaft is moving to the right when the core latch gear is not moving to the right, rack gear 323 engages spur gear 324 to cause the core latch gear to rotate inwardly away from the paper core. Once the core latch gear has rotated inwardly the shaft collar engages the bearing to cause the entire assembly to move to the right thereby withdrawing the core latch chuck assembly from the core allowing it to drop to the ground.

Figure 8:
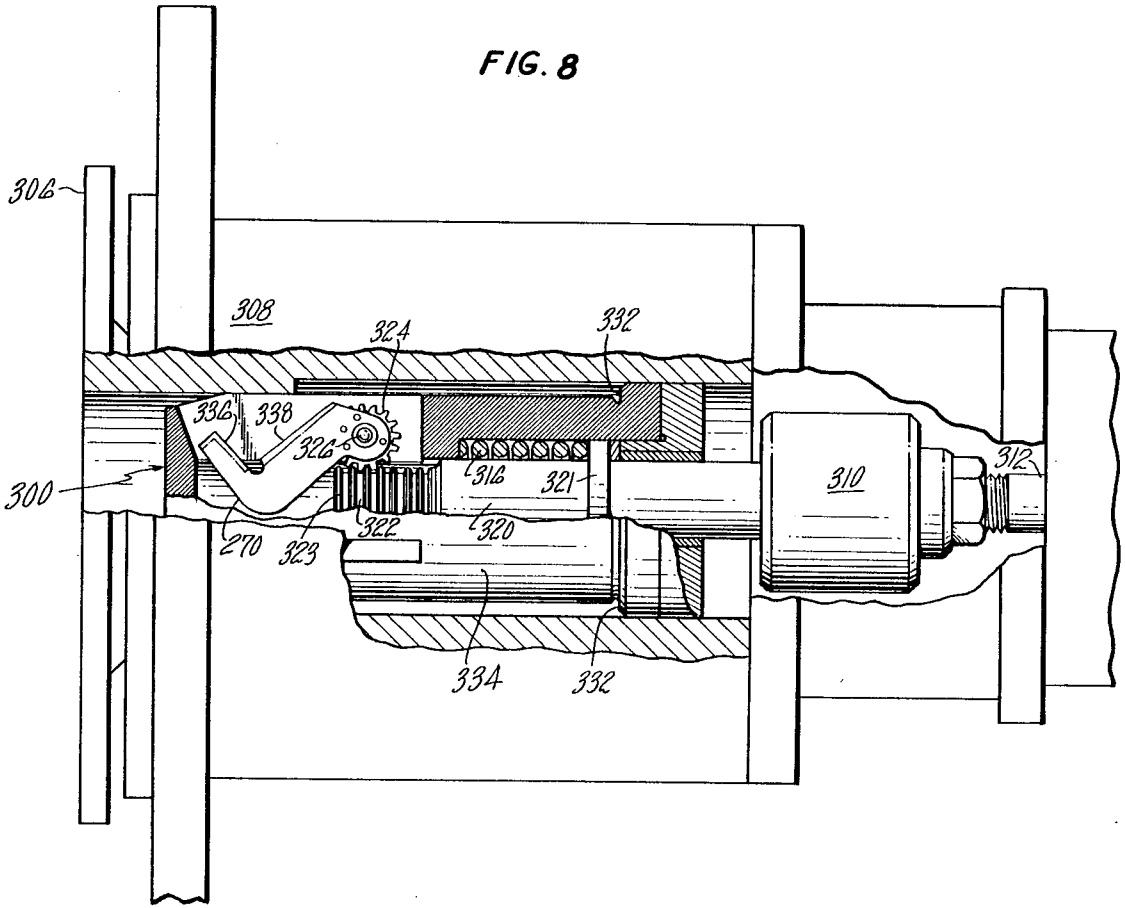
FIG. 8 is a partially cutaway schematic view of a core chuck assembly shown in the retracted position.

FIG. 8 shows the core latch chuck assembly contained within the frame of the payoff assembly in position to be inserted into a paper roll. In this position the core latch gears are rotated to a position within the assembly casing and do not act to engage a paper roll. To mount the paper roll the robot assembly places the paper roll in position and actuator 312 then displaces the core latch gear from right to left. As the core latch gear travels from right to left, the assembly is inserted into the core until abutment face 332 engages frame 308 to prevent the entire assembly from moving further in the right to left direction. At this point the actuator continues to move from right to left and consequently the shaft is moved from right to left. The spring is compressed and the rack gear drives the spur gear to rotate the core latch gear outwardly to secure the paper roll in the desired position.

Figure 9:
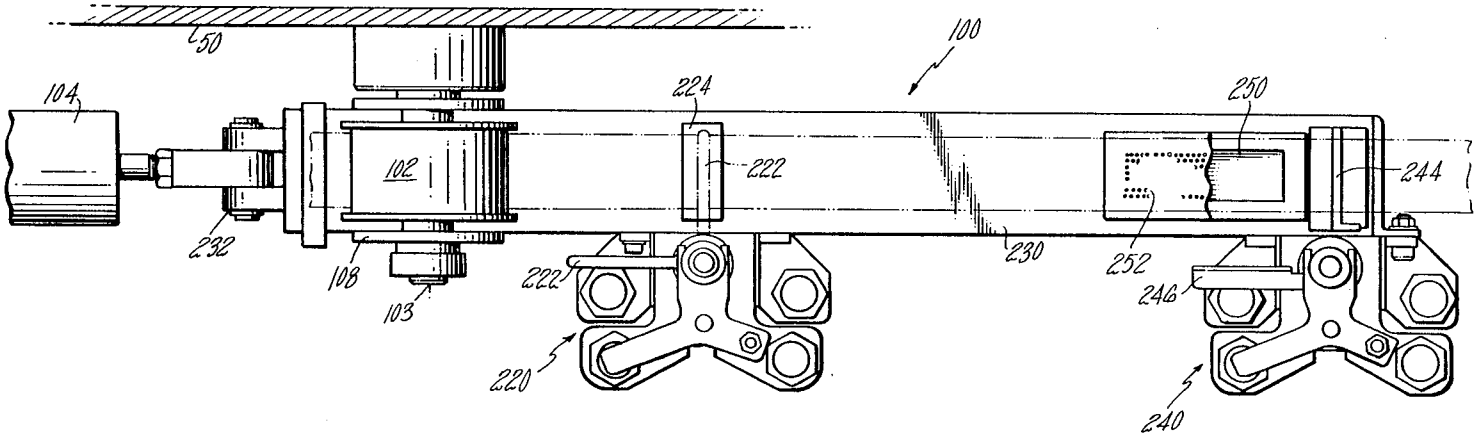
FIG. 9 is a top view of the paster arm.

Referring now to FIG. 9 and we see an enlarged view of a portion of paster arm assembly 100. Actuator 104 is shown as a pressurized cylinder for causing paster arm assembly 100 to rotate about pivot point 103. Actuator 104 is connected to the main body of the paster arm assembly via pivot connection 232. Arm support 108 extends from pulley 102 to paster arm 230 to support same relative to pivot point 103. The paper payoff assembly frame 50 is shown indicating that portion of the machine to which the paster arm is secured.

Ribbon clamp assembly 220 is shown mounted on the side of paster arm 230. The ribbon clamp assembly includes a clamp bar 222 which may be rotated from a closed position as shown to an open position wherein ribbon 60 is secured between clamp pad 224 and clamp bar 222. Paster arm 230 additionally has vacuum cup 250 secured on the top thereof such that the paper ribbon travels across the top of the vacuum cup. A neoprene cover 252 is shown partially in section having a plurality of openings such that a suction is drawn through each opening to secure the paper in position.

Ribbon knife assembly 240 is shown mounted at the end of paster arm 230 and includes stationary knife blade 244 and a rotating knife blade 246. When actuated the knife assembly acts to displace the rotating knife upwardly and to rotate it out over the paper ribbon. It is then displaced downwardly to cut the ribbon prior to being rotated back to the original position. The ribbon clamp assembly works in a similar manner with the clamp bar being displaced upwardly and then rotated outwardly over the ribbon. The clamp bar is then displaced downwardly to secure the ribbon in position. Upon being released the clamp bar is displaced upwardly and then rotated back to its original position.

Figure 10:
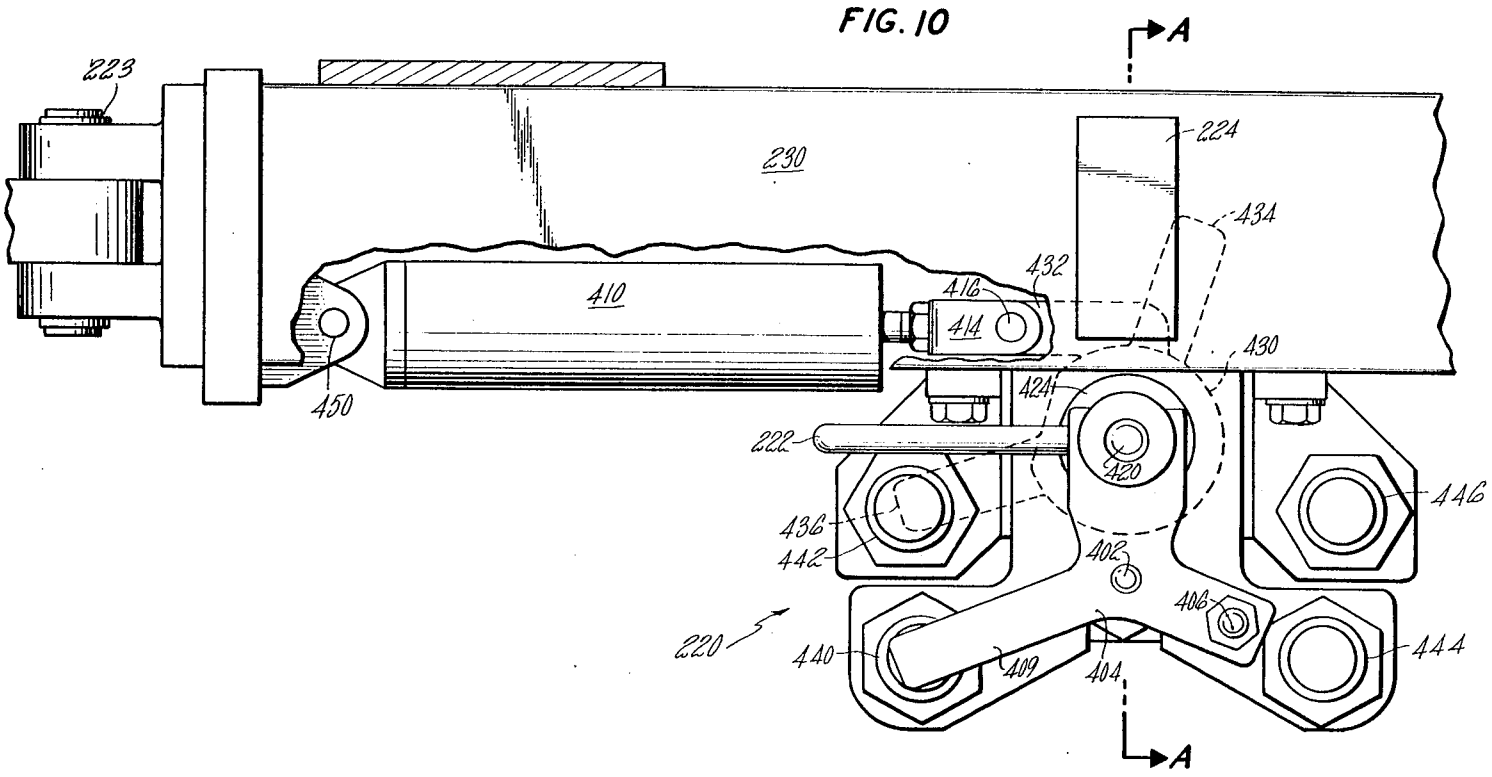
FIG. 10 is an enlarged top view of the clamp assembly of the paster arm.
Figure 11:
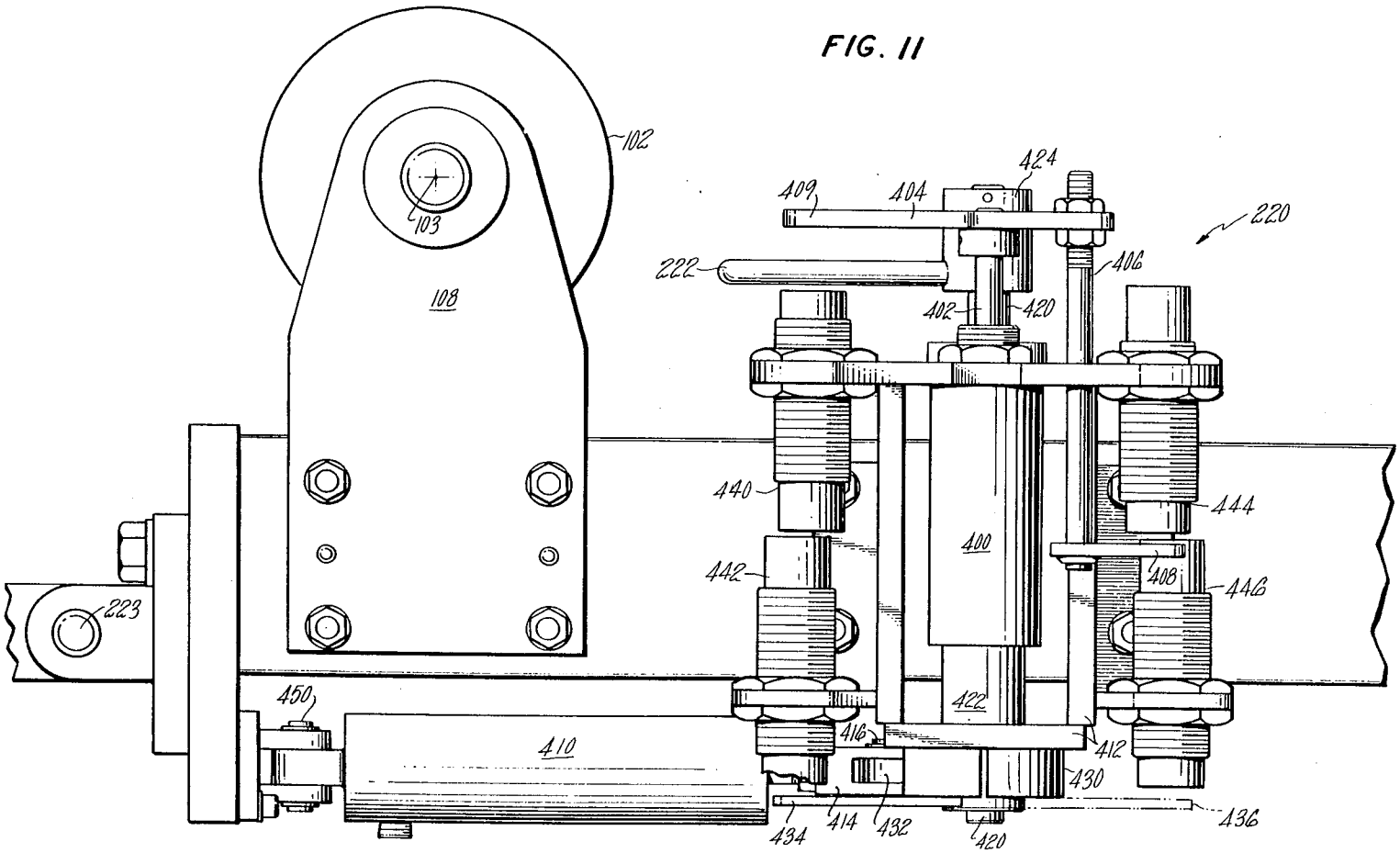
FIG. 11 is an enlarged side view of the clamp assembly.
Figure 12:
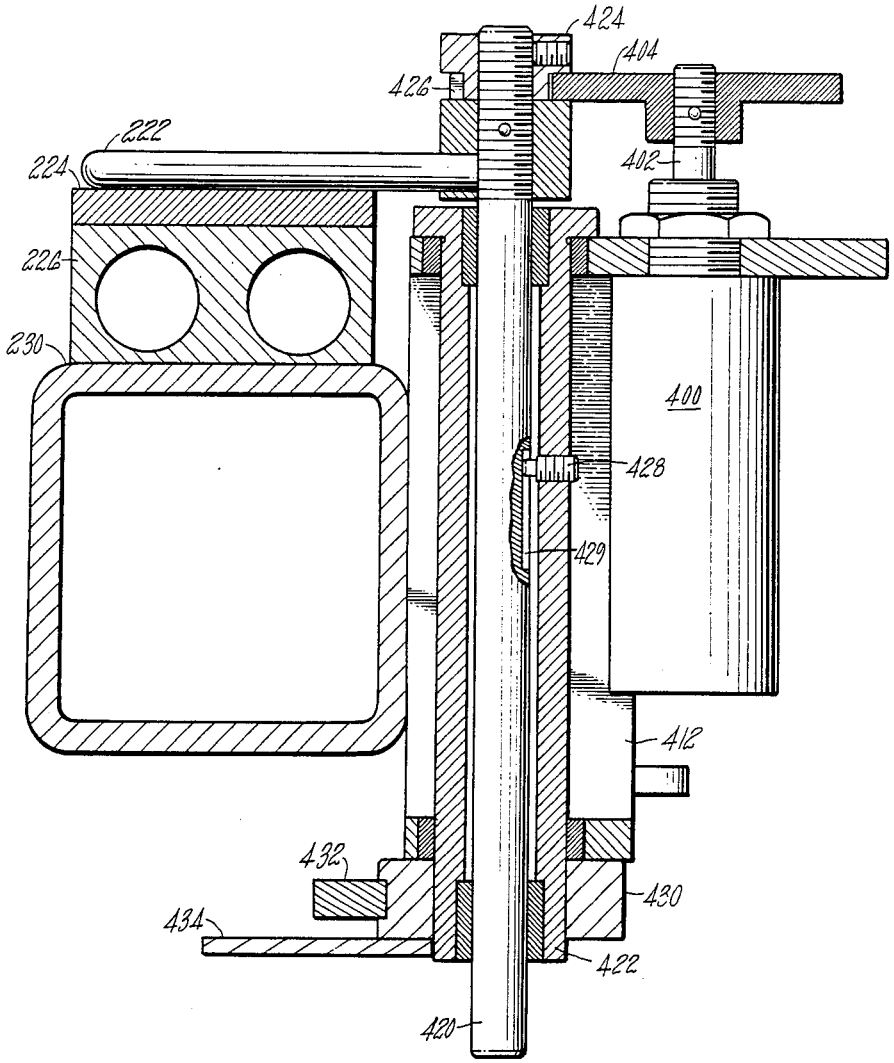
FIG. 12 is a sectional view of the paster arm assembly taken at line A—A from FIG. 11.

Referring now to FIGS. 10, 11 and 12 the specific details of the ribbon clamp assembly will be disclosed. The details of construction and operation of the ribbon clamp assembly are identical to those of the knife assembly.

FIG. 10 is a top view of ribbon clamp assembly 220 similar to the view as seen in FIG. 9. In FIG. 10 it may be seen that a rotation cylinder 410 is mounted at the bottom of paster arm 230 and is connected thereto via pivot connection 450. This rotation cylinder is the device that imparts rotational displacement to the clamp bar. Also as seen from the top view of FIG. 10 is clamp pad 224 and clamp bar 222. It is between clamp bar 222 and clamp pad 224 that the ribbon is secured.

Spaced about the assembly are position sensors 440, 442, 444 and 446. Each sensor cooperates with a position indicator to sense the presence of metal at a desired location. The sensor is utilized to determine that the clamp bar has been moved as desired. It will be explained more particularly in reference to another view the manner in which the sensors cooperate with the indicators to determine that the clamp bar is in the desired position.

Clamp bar 222 is mounted to hub 424 which is mounted about shaft 420. Yoke 404 is engaged within a slot defined by hub 424 such that an upward or downward displacement of yoke 404 causes the hub and the attached clamp bar to be displaced upwardly or downwardly.

Rotation cylinder 410 has cylinder yoke 414 extending therefrom. Collar 430 having a collar extension 432 extending therefrom is mounted to the bottom of shaft 420. The collar extension has an opening therein through which pin 416 extends connecting collar extension 432 to cylinder yoke 414. Hence, by energization of the rotation cylinder the collar extension 432 is caused to be displaced acting to rotate the collar which rotates the sleeve which rotates the shaft and consequently rotates hub 424 and clamp bar 222. The in position indicator 423 and the out position indicator 436 are shown in the drawing. Additionally shown is connecting rod 406 extending from yoke 404. The down position indicator 409 is also shown extending from yoke 404.

Referring now to FIGS. 11 and 12 a different view of the assembly may be seen. FIG. 11 is a side view of the paster arm assembly showing pivot connection 223 and arm support 108 engaged to pivot point 103 which also supports pulley 102. Rotation cylinder 410 is shown mounted at the bottom of the arm and is secured thereto by pivot connection 450.

Clamp bar 222 is shown in the up position and is partially hidden by down position indicator 409. As shown in the up position, up-down cylinder 400 has been energized to cause rod 402 to be displaced upwardly moving yoke 404 upward. Yoke 404 is connected to hub 424 and acts to cause the hub with the attached clamp bar to be displaced upwardly. Shaft 420 also attached to the hub is displaced upwardly simultaneously. Extending from yoke 404 is down position indicator 409.

Additionally in FIG. 11 there may be seen down position sensor 440, out position sensor 442, up position sensor 444 and in position sensor 446. Connecting rod 406 is shown extending downwardly from yoke 404 and has up position indicator 408 extending therefrom.

As shown the yoke has been displaced upwardly by up-down cylinder 400. Hence, down position indicator 409 is displaced from down position sensor 440 such that the down position sensor which is a simple RF sensor indicating the presence of metal in proximity thereto does not sense the down position. At the same time via connecting rod 406, up position indicator 408 has been moved into proximity with up position sensor 444 which then senses that the clamp bar is in the up position. When the up-dowm cylinder is in the down position the entire assembly is moved downwardly such that up position indicator 408 is moved away from up position sensor 444 such that it does not detect the presence of metal and simultaneously down position indicator 409 is moved into close proximity to down position sensor 440 such that is does detect the presence of metal in close proximity. Hence, the up or down position may be affirmatively detected in either instance.

Similarly, in position indicator 436 and out position indicator 434 are mounted to collar 430 which is secured to rotate with shaft 420. When the clamp bar is in the in position, in position indicator 436 is in close proximity to in position sensor 446 and out position indicator 434 is rotated away from out position sensor 442. The opposite position is indicated when the clamp bar has been rotated to the out position. In this case the in position indicator 436 is rotated away from in position sensor 446 and out position indicator 434 is rotated into close proximity to out position sensor 442 such that the out position is detected. Hence, in this manner the relative out or in rotational position of the clamp bar is affirmatively sensed.

Rotating cylinder 410 is shown connected through cylinder yoke 414 by pin 416 to collar extension 432 connected to collar 430. By displacement of the cylinder yoke the collar is caused to rotate through collar extension 432 thereby causing the clamp bar to rotate.

FIG. 12 is a sectional view of clamp bar assembly 220 taken at line A—A of FIG. 10. Paster arm 230 is shown being a square structural member having a clamp pad support 226 mounted to the top thereof. Clamp pad 224 is mounted at the top of clamp pad support and is a soft surface such as rubber which coacts with clamp bar 222 to secure the ribbon therebetween.

Mounted at the right portion of the drawing is shown up-down cylinder 400 having rod 402 extending therefrom into engagement with yoke 404. Yoke 404 is shown extending into slot 426 within hub 424. Hence it may be seen as up-down cylinder 400 is either extended or retracted the hub is caused to be displaced either upwardly or downwardly effecting displacement of clamp bar 222 either upwardly or downwardly.

Hub 424 is shown mounted to shaft 420 for both rotation and up-down displacement therewith. Shaft 420 is secured within sleeve 422 for relative axial sliding displacement thereto. Drive pin 428 is shown extending through sleeve 422 and being engaged within a slot 429 defined by the shaft such that the sleeve is caused to rotate with the shaft and vice versa. Collar 430 is shown secured to the exterior surface of sleeve 422 and has collar extension 432 extending therefrom. It is to this collar extension that cylinder yoke 414 is connected for effecting rotation of the collar extension to rotate the collar, to rotate the sleeve, which rotates the shaft, which rotates the clamp bar. Hence, in this manner the clamp bar may be rotated between the in and out positions. Simultaneously the shaft may be slid upwardly and downwardly by the action of up-down cylinder 400. Out position indicator 434 is shown at the bottom of the drawing connected to collar 430 for relative rotational displacement therewith.

Hence, as may be seen in the ribbon clamp assembly and in the same manner for the knife clamp assembly, each provide for the clamp bar or a knife blade to be displaced upwardly, rotated out over the ribbon and then displaced downwardly to either clamp the ribbon in position or to sever the ribbon in coaction with a stationary knife blade. To reverse the cycle the clamp bar or knife blade is displaced upwardly and rotated back into the starting rotational position and then displaced downwardly into the start position. Hence, the two assemblies act to effect both rotational and vertical displacement of the desired apparatus.

The invention has been described with reference to a particular embodiment. It is to be understood by those skilled in the art that variations and modifications can be effected within the spirit and scope of the invention.

I claim:

1. A roll payoff unit for unwinding rolls of ribbon material having a central annular core and an outside diameter which comprises:

a retractable core chuck upon which the roll of material is mounted, said chuck having a first position wherein the roll is secured through the core and a second position wherein the chuck is retracted releasing the roll;

a drive belt assembly including an endless drive belt engaging the exterior surface of the roll, said assembly being pivotally mounted to continuously engage the outside diameter of the roll as the roll diameter decreases during unwinding of the roll;

pulley means for guiding the ribbon being unwound from the roll;

dancer means connected to the ribbon to sense and control ribbon tension by regulating the speed of the endless drive belt; and a paster arm assembly for use in joining the trail end of the ribbon from a consumed roll to the beginnng end of the ribbon from a new roll including means for clamping the ribbon and means for cutting the ribbon, said assembly being mounted to pivot between several positions including a cutting position in registration with the ribbon when the roll is almost completely consumed and an unwinding position not in registration with the ribbon.

2. The apparatus as set forth in claim 1 and further comprising:

means mounted to the roll payoff unit for applying an adhesive to the ribbon.

3. The apparatus as set forth in claim 1 wherein the paster arm assembly includes a ribbon guide pulley having a center axis and an arm support having the center axis of the ribbon guide pulley as a pivot point whereby the paster arm assembly may be pivoted about the ribbon guide pulley center axis.

4. The apparatus as set forth in claim 3 and further comprising an actuator for displacing the paster arm assembly about the ribbon guide pulley axis.

5. The apparatus as set forth in claim 3 and further comprising the clamping means being positioned on the paster arm assembly a fixed distance from the center axis such that tension on the ribbon between the dancer means and the clamping means is maintained regardless of the position of the paster arm assembly.

6. The apparatus as set forth in claim 2 wherein the means for applying adhesive is mounted to the payoff unit and wherein the paster arm assembly has an adhesive position wherein the ribbon may be placed in registration with the means for applying adhesive.

7. The apparatus as set forth in claim 6 and further comprising:

vacuum means mounted to the paster arm assembly for securing the ribbon in position relative to the paster arm for the application of adhesive.

8. The apparatus as set forth in claim 6 wherein the roll of material includes a paster tab securing the beginning end of the roll to the first layer of the roll to prevent unwinding and which further comprises:

said roll having been placed on the core chuck with the paster tab in a preselected position; and said paster arm having a fastening position wherein the arm is rotated to have the ribbon with applied adhesive placed in contact with the paster tab.

9. Apparatus for splicing the trail end of a roll of ribbon material onto the beginning end of a new roll of material which comprises:

a core chuck for securing both the old and new rolls for rotational movement to effect unwinding, said rolls being mounted on the chuck in a preselected orientation;

a pivotally mounted paster arm assembly including:

a) clamp means for releasably securing the ribbon to maintain tension on the ribbon;

b) knife means for severing the ribbon; and c) vacuum means for holding the severed end of the ribbon in a desired position;

adhesive means for applying adhesive to the ribbon where secured by the vacuum means; and actuator means for displacing the paster arm assembly, between a first position wherein adhesive may be applied to the trail end of the ribbon and a second position wherein the trail end of the ribbon is placed in contact with the new roll to splice the trail end of a roll to the beginning end of a new roll of material.

10. The apparatus as set forth in claim 9 wherein the paster arm assembly further comprises a ribbon guide pulley having a center axis and wherein the paster arm assembly is connected to pivot about the same axis whereby rotation of the pivot arm assembly does not materially change the ribbon length from the clamping means downstream.

11. The apparatus as set forth in claim 9 wherein the adhesive means is mounted to have a first position in which the paster arm assembly may rotate past the adhesive means and a second position wherein adhesive may be applied to the ribbon.

12. The apparatus as set forth in claim 9 wherein the vacuum means defines a concave surface having a plurality of openings through which a vacuum is drawn to hold the ribbon in position.

13. A method of splicing the trail end of a ribbon from an old roll of ribbon material to a new roll of ribbon material which comprises the steps of:

stopping an old roll of ribbon from further unwinding just before the old roll is completely unwound;

clamping the ribbon to maintain the tension of the ribbon from the position where it is clamped downstream;

severing the ribbon between where it is clamped and the old roll;

holding the severed trail end from the old roll in a fixed position;

removing the old roll of ribbon;

mounting a new roll of ribbon;

applying adhesive to the severed trail end of the old roll of ribbon; and placing the trail end of the old roll into contact with the beginning end of the new roll to secure the two ends to each other.

14. The apparatus as set forth in claim 13 wherein the new roll of ribbon includes a paster tab securing the beginning end of ribbon to the next layer of ribbon and wherein the step of mounting a new roll of ribbon further comprises the step of orienting the new roll of ribbon to place the paster tab in a preselected position and wherein the step of placing further comprises placing the trail end of the old roll onto the paster tab of the new roll of ribbon.

15. The method as set forth in claim 13 wherein the steps of clamping, severing and holding are all initiated simultaneously.

* * * * *